US008959679B1

(12) United States Patent
Everds et al.

(10) Patent No.: US 8,959,679 B1
(45) Date of Patent: Feb. 24, 2015

(54) BEACH BLANKET ASSEMBLY

(71) Applicants: Katie Everds, Beverly Hills, CA (US); Robert P. Jacobs, Beverly Hills, CA (US)

(72) Inventors: Katie Everds, Beverly Hills, CA (US); Robert P. Jacobs, Beverly Hills, CA (US)

( * ) Notice: Subject to any disclaimer, the term of this patent is extended or adjusted under 35 U.S.C. 154(b) by 164 days.

(21) Appl. No.: 13/774,348

(22) Filed: Feb. 22, 2013

(51) Int. Cl.
*A47G 9/06* (2006.01)

(52) U.S. Cl.
CPC ..... *A47G 9/062* (2013.01)
USPC ..... 5/419; 5/417; 5/656; 206/38

(58) Field of Classification Search
USPC ..... 5/417, 419, 656, 482; 206/38
See application file for complete search history.

(56) References Cited

U.S. PATENT DOCUMENTS

| | | | | |
|---|---|---|---|---|
| 3,689,947 | A | 9/1972 | Wolf | |
| D318,772 | S | 8/1991 | Phillips | |
| D336,199 | S | 6/1993 | Bazata, Jr. | |
| 5,644,807 | A | 7/1997 | Battistella | |
| 5,729,846 | A | 3/1998 | Sullivan | |
| 5,819,346 | A * | 10/1998 | Lane | 5/639 |
| 6,182,309 | B1 | 2/2001 | Sullivan | |
| 6,839,921 | B2 | 1/2005 | Cloutier et al. | |
| 2005/0217048 | A1* | 10/2005 | Elie et al. | 15/209.1 |
| 2014/0231277 | A1* | 8/2014 | Ponski | 206/38 |

* cited by examiner

*Primary Examiner* — Peter M Cuomo
*Assistant Examiner* — Brittany Wilson

(57) ABSTRACT

A beach blanket assembly facilitates comfortable relaxation while also providing secure storage of items. The assembly includes a sheet having a first face, a second face, and a perimeter edge extending around the first face and the second face. A pillow is coupled to the sheet and extends from the first face. A first pocket is coupled to the first face. An aperture extends through the first pocket wherein the first pocket is configured for holding a device therein. A wire may extend from the device through the aperture.

12 Claims, 4 Drawing Sheets

BEACH BLANKET ASSEMBLY

BACKGROUND OF THE DISCLOSURE

Field of the Disclosure

The disclosure relates to blanket devices and more particularly pertains to a new blanket device for facilitating comfortable relaxation while also providing secure storage of items.

SUMMARY OF THE DISCLOSURE

An embodiment of the disclosure meets the needs presented above by generally comprising a sheet having a first face, a second face, and a perimeter edge extending around the first face and the second face. A pillow is coupled to the sheet and extends from the first face. A first pocket is coupled to the first face. An aperture extends through the first pocket wherein the first pocket is configured for holding a device therein. A wire may extend from the device through the aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
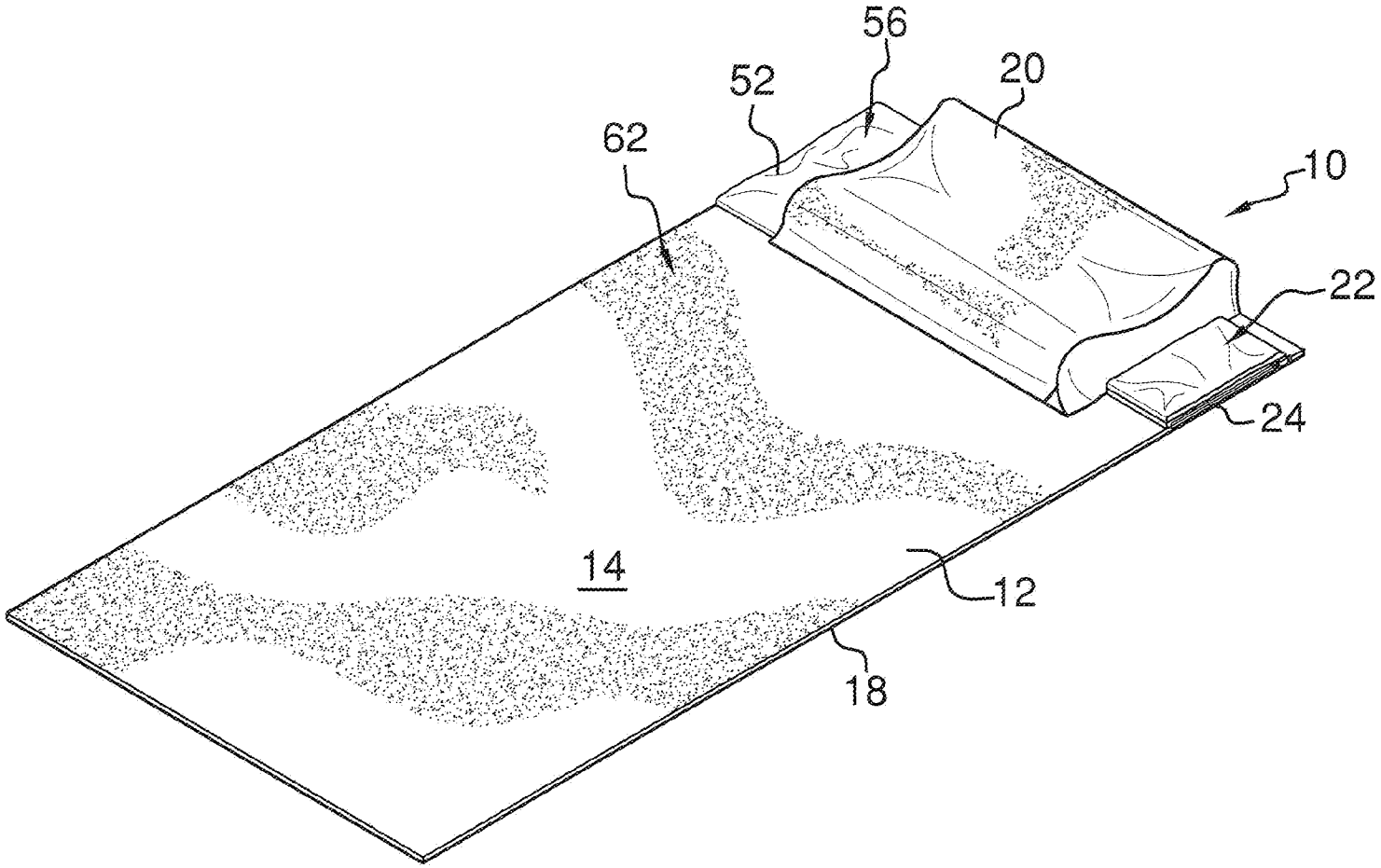
FIG. 1 is a top front side perspective view of a beach blanket assembly according to an embodiment of the disclosure.
Figure 2:
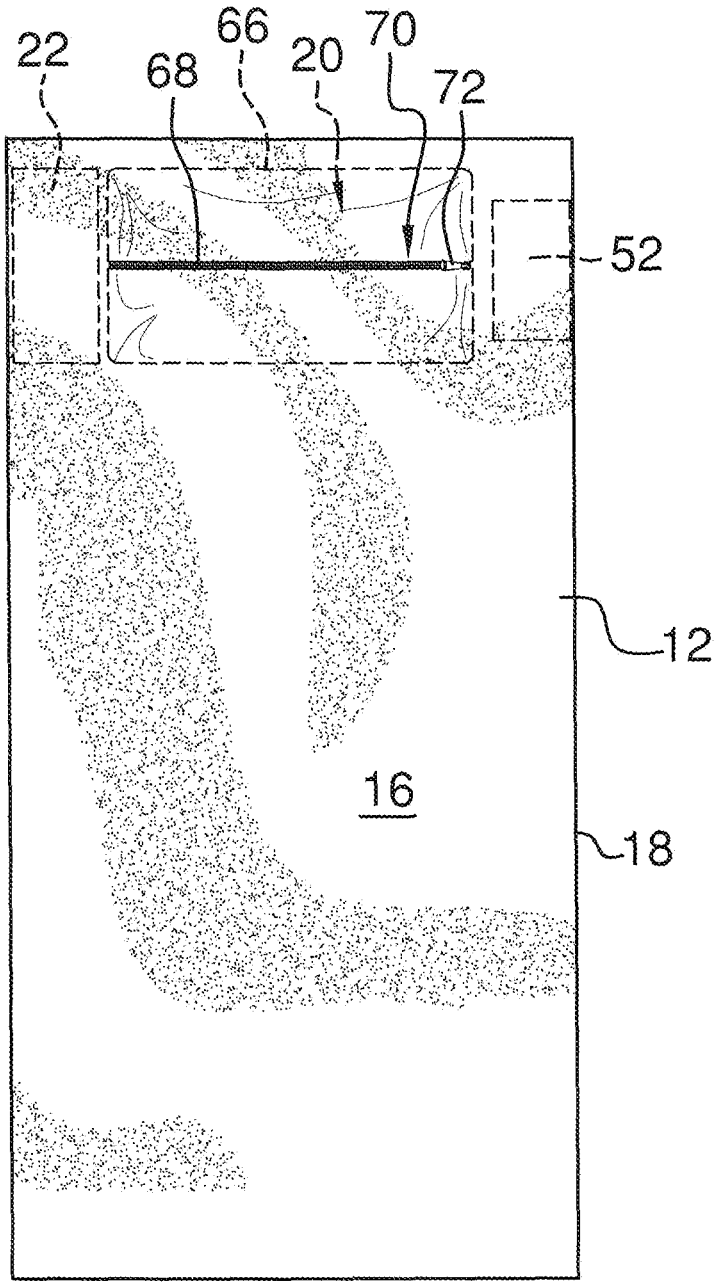
FIG. 2 is a bottom view of an embodiment of the disclosure.
Figure 3:
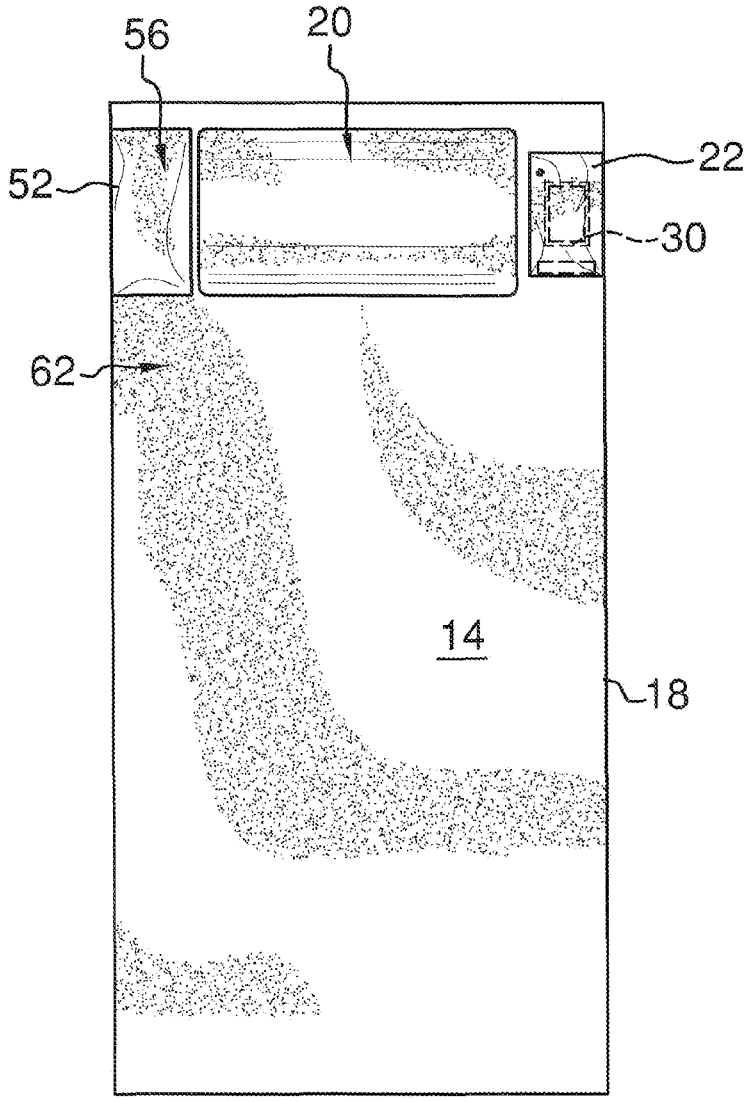
FIG. 3 is a top view of an embodiment of the disclosure.
Figure 4:
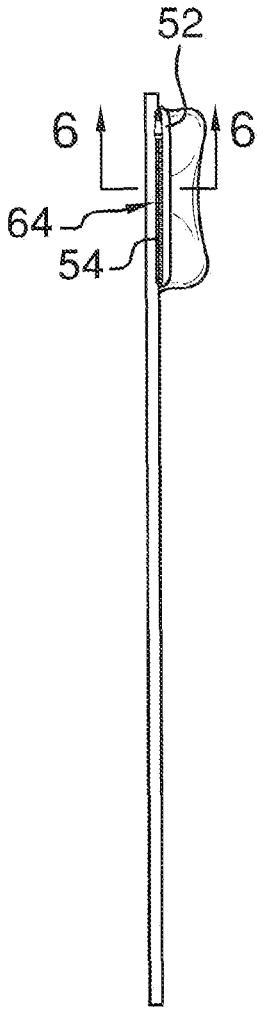
FIG. 4 is a side view of an embodiment of the disclosure.
Figure 5:
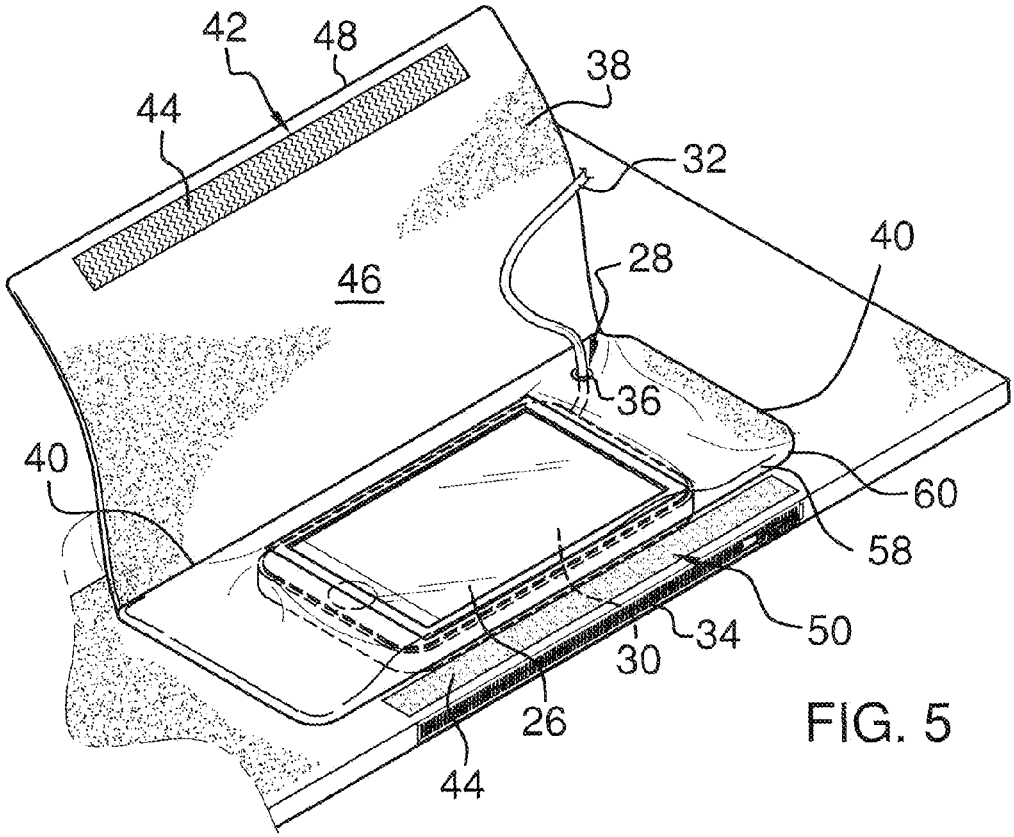
FIG. 5 is a partial top front side perspective view of an embodiment of the disclosure.
Figure 6:
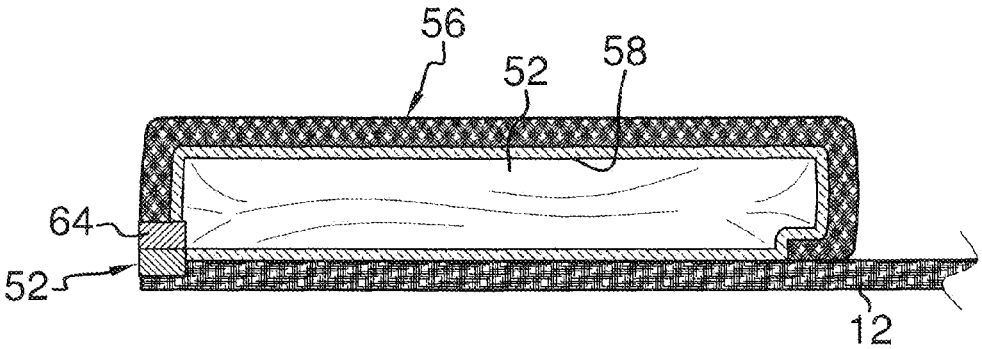
FIG. 6 is a cross-sectional view of an embodiment of the disclosure taken along line 6-6 of FIG. 4.

With reference now to the drawings, and in particular to FIGS. 1 through 6 thereof, a new blanket device embodying the principles and concepts of an embodiment of the disclosure and generally designated by the reference numeral 10 will be described.

As best illustrated in FIGS. 1 through 6, the beach blanket assembly 10 generally comprises a sheet 12 having a first face 14, a second face 16, and a perimeter edge 18 extending around the first face 14 and the second face 16. The sheet 12 may be constructed of a substantially soft planar material such as terry cloth or the like. A pillow 20 is coupled to the sheet 12 such that the pillow 20 extends upwardly from the first face 14 of the sheet 12. A first pocket 22 is coupled to the first face 14. The first pocket 22 is positioned adjacent to the pillow 20 and abuts the perimeter edge 18. The first pocket 22 has an opening 24. The opening 24 into the first pocket 22 is positioned adjacent to and extends along the perimeter edge 18 of the sheet 12 between the first face 14 and the second face 16. The first pocket 22 has a transparent top panel 26 configured for providing visual monitoring of contents inserted into the first pocket 22. A waterproof layer 58 may be coupled to and line an interior surface 60 of the first pocket 22. The layer 58 may be water-resistant as opposed to completely waterproof if so desired.

An aperture 28 extends through the first pocket 22 wherein the first pocket 22 is configured for holding a device 30 therein such as a digital music player or a phone. A wire 32 may extend from the device 30 through the aperture 28 to permit the use of headphones while the head is being supported on the pillow 20 and the device 30 is positioned in a protected position within the first pocket 22. A grommet 36 may be coupled to and surround the aperture 28. A first closure 34 is coupled to and extends along the opening 24 into the first pocket 22. A flap 38 may have a first long edge 40 coupled to the first face 14 of the sheet 12. The flap 38 has a sufficient length to selectively cover the top panel 26 of the first pocket 22. A fastener 42 such as a hook and loop fastener 44 may be applied to a bottom surface 46 of the flap 38 proximate a second long edge 48 of the flap 38. The fastener 42 may attach directly to the sheet 12 or a portion of the top panel 26. A complementary portion of fastener 50 may be provided to engage the fastener 42. A top surface of the flap 38 may have having an appearance matching an appearance of a top surface 62 of the sheet 12 is not readily apparent to spectators and may be used to store valuables inconspicuously.

A second pocket 52 is coupled to the sheet 12. The second pocket 52 is positioned adjacent to the pillow 20 such that the pillow 20 is positioned between the first pocket 22 and the second pocket 52. The second pocket 52 also has an opening 54. The opening 54 into the second pocket 52 may be positioned adjacent to and extend along the perimeter edge 18 of the sheet 12. The second pocket 52 has a top surface 56 having an appearance matching an appearance of the top surface 62 of the sheet 12 wherein the second pocket 52 is also not readily apparent to spectators and may be used to store valuables inconspicuously. A waterproof layer similar to the layer 58 in the first pocket 22 may be coupled to and line an interior surface of the second pocket. A second closure 64 is coupled to and extends along the opening 54 into the second pocket 52.

A pillow chamber 66 may be positioned between the first face 14 and the second face 16 of the sheet 12 and extending outwardly from the first face 14 of the sheet 12. The pillow 20 is positioned in the pillow chamber 66. A pillow opening 68 extends through the second face 16 of the sheet 12 into the pillow chamber 66 to provide access to the pillow chamber 66 as needed. A closure 70 such as a zipper 72 is coupled to and extends along a length of the pillow opening 68. The pillow chamber 66 may also have a waterproof or water resistant layer similar to layer 58 described above.

In use, the device 30 is stored in the first pocket 22 providing access to headphones having the wire 32 of the headphones extending through the aperture 28 in the first pocket 22. The flap 38 may be moved as desired to cover the device 30 or the device 30 may be viewed through the top panel 26 of the first pocket 22. Valuables may be placed into the second pocket 52 for inconspicuous storage while using the sheet 12 at a desired location such as a beach.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A blanket assembly comprising:

a sheet having a first face, a second face, and a perimeter edge extending around said first face and said second face;

a pillow coupled to said sheet wherein said pillow extends from said first face;

a first pocket coupled to said first face, said first pocket having a transparent top panel;

an aperture extending through said first pocket wherein said first pocket is configured for holding a device therein wherein a wire extends from the device through said aperture; and a flap coupled to said sheet, said flap selectively covering said top panel of said first pocket.

2. The assembly of claim 1, further comprising said first pocket being positioned adjacent to said pillow.

3. The assembly of claim 1, further comprising said first pocket having an opening, said opening being positioned adjacent to and extending along said perimeter edge of said sheet.

4. The assembly of claim 1, further comprising a first closure coupled to and extending along said opening into said first pocket.

5. The assembly of claim 1, further comprising a second pocket, said second pocket being coupled to said first face of said sheet.

6. The assembly of claim 5, further comprising said second pocket being positioned adjacent to said pillow.

7. The assembly of claim 5, further comprising said second pocket having a top surface, said top surface of said second pocket having an appearance matching an appearance of a top surface of said sheet.

8. The assembly of claim 1, further comprising a waterproof layer coupled to and lining an interior surface of said first pocket.

9. The assembly of claim 1, further comprising:

a pillow chamber positioned between said first face and said second face of said sheet;

a pillow opening extending through said second face of said sheet into said pillow chamber; and said pillow being positioned in said pillow chamber.

10. The assembly of claim 1, further comprising said pillow having a pair of outer portions and a medial portion positioned between said outer portions, said outer portions each having a thickness greater than said medial portion wherein a channel extends between said outer portions.

11. The assembly of claim 9, further comprising a closure coupled to and extending along a length of said pillow opening.

12. A blanket assembly comprising:

a sheet having a first face, a second face, and a perimeter edge extending around said first face and said second face;

a pillow coupled to said sheet wherein said pillow extends from said first face of said sheet;

a first pocket coupled to said first face, said first pocket being positioned adjacent to said pillow, said first pocket having an opening, said opening into said first pocket being positioned adjacent to and extending along said perimeter edge of said sheet, said first pocket having a transparent top panel;

an aperture extending through said pocket wherein said pocket is configured for holding a device therein wherein a wire extends from the device through said aperture;

a first closure coupled to and extending along said opening into said first pocket;

a flap coupled to said sheet, said flap selectively covering said top panel of said first pocket;

a second pocket, said second pocket being coupled to said first face of said sheet, said second pocket being positioned adjacent to said pillow, said first pocket having an opening, said opening into said second pocket being positioned adjacent to and extending along said perimeter edge of said sheet, said second pocket having a top surface, said top surface of said second pocket having an appearance matching an appearance of a top surface of said sheet;

a waterproof layer coupled to and lining an interior surface of said first pocket;

a second closure coupled to and extending along said opening into said second pocket;

a pillow chamber positioned between said first face and said second face of said sheet, said pillow being positioned in said pillow chamber;

a pillow opening extending through said second face of said sheet into said pillow chamber; and a closure coupled to and extending along a length of said pillow opening.

* * * * *